US006918602B2

(12) United States Patent
Lu

(10) Patent No.: US 6,918,602 B2
(45) Date of Patent: Jul. 19, 2005

(54) ROLLER SKATES WITH ADJUSTABLE LONGITUDINAL DIMENSION

(76) Inventor: Su-Hsian Yiu Lu, 5F., No. 62, Sec. 2, Mingde Rd., Tucheng City, Taipei County (TW)

( * ) Notice: Subject to any disclaimer, the term of this patent is extended or adjusted under 35 U.S.C. 154(b) by 0 days.

(21) Appl. No.: 10/662,343

(22) Filed: Sep. 16, 2003

(65) Prior Publication Data

US 2005/0057008 A1 Mar. 17, 2005

(51) Int. Cl.[7] ..... A63C 1/22
(52) U.S. Cl. ..... 280/11.26
(58) Field of Search ..... 280/11.16, 11.26, 280/11.19, 11.27

(56) References Cited

U.S. PATENT DOCUMENTS 4,684,150 A * 8/1987 Specktor et al. ..... 280/86.753
5,484,149 A * 1/1996 Lee ..... 280/11.26
6,308,965 B1 * 10/2001 Yang ..... 280/11.221
6,547,261 B2 * 4/2003 Gorza et al. ..... 280/11.223
6,612,592 B1 * 9/2003 Soo ..... 280/11.16
2003/0020245 A1 * 1/2003 Li ..... 280/11.26
2003/0141679 A1 * 7/2003 Hong ..... 280/11.26

* cited by examiner

*Primary Examiner*—Bryan Fischmann
(74) *Attorney, Agent, or Firm*—Birch, Stewart, Kolasch & Birch, LLP

(57) ABSTRACT

A roller skate with an adjustable longitudinal dimension for adjusting the dimension of the shoe cap of the roller skate includes an anchor section under a two-piece shoe cap that has a first coupling section. An adjusting bolt is provided on the truck with a second coupling section and a sliding trough. The adjusting bolt may be moved horizontally through an elastic element. When the elastic element is depressed, the sliding trough is slid to the first coupling section of the anchor section to enable the shoe cap to be moved forwards and rearwards. When the elastic element is released, the two coupling sections are latched together to anchor the shoe cap. Thus the longitudinal dimension of the roller skate may be adjusted as desired.

8 Claims, 7 Drawing Sheets

ROLLER SKATES WITH ADJUSTABLE LONGITUDINAL DIMENSION

FIELD OF THE INVENTION

The present invention relates to roller skates with an adjustable longitudinal dimension and particularly to a mechanism that provides a coupling section for latching and anchoring and a sliding trough for moving to adjust the dimension.

BACKGROUND OF THE INVENTION

In-line roller skates basically can be grouped into five types that have different designs and characteristics to achieve different functions as follows:

1. Leisure skates: they are the most common type, and usually consist of an inner pad and a shoe cap. They mainly aim at providing comfort and safety, and are designed for recreational use for the general public. The wheels and bearings are replaceable according to user's preferences and requirements. 2. Stunt skates: whether with a U-shaped deck or jumping board, they have special design requirements. As they are used for many jumping actions, they require a balanced base deck and a sturdy and well-covered inner pad to avoid exercise injury. They also are of a smaller size and have a flat and wider shape to make landing on the ground more stable. They usually are coupled with straps and lateral sliding flaps and a base deck guarding flap. 3. Hockey skates: they usually adopt an integrated form without inner pad so that they enable the foot to fit the shoe more closely, and so that forward motion and goal shooting may be exercised quickly. Their material is mainly leather. 4. Speeding skates: generally use high class wheels and more precise bearings, and usually have five wheels. The base deck mostly is made of aluminum alloy. The wheels have diameters ranging from 76 mm to 80 mm, and usually are formed in a sharp profile to reduce friction force with the ground surface. 5. Figure skates: usually have a base deck coupling with three or four wheels, and have a stop at the front end of the base deck to facilitate performing pivot and leap actions.

The adjustable roller skates now available on the market as shown in FIGS. 1 and 2 mainly have a straight slot or anchor holes on the truck or the lateral side. There is a sliding mechanism located on the bottom of the roller skate. Screws are coupled on the straight slot or anchor holes for anchoring the position. When the screws are unfastened, the shoe cap may be slid freely on the truck to adjust the dimension. Once the dimension is decided, the screws are fastened to the straight slot or anchor holes. Hence the dimension of the shoe cap may be adjusted for more than one person to wear. As the anchor holes have limited intervals, the dimension adjusting range of the roller skates also is limited. The straight slot does not have such a problem, and thus can adjust the dimension more freely. However, the screws are difficult to fasten and easy to get lost. All of this often causes inconvenience when in use.

SUMMARY OF THE INVENTION

The primary object of the invention is to resolve the aforesaid disadvantages. The invention consists of:

a two-piece shoe cap which includes a toe cap and a heel cap. The shoe cap has an anchor section on the bottom for anchoring use;

a truck having a bottom to couple with wheels thereunder to form the roller skate and brace the two-piece shoe cap and enable the two-piece shoe cap to slide thereon, and a housing trough formed on a lateral side at a desired location; and an adjusting bolt housed in the housing trough to mate a track formed on the truck and being movable on the truck.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
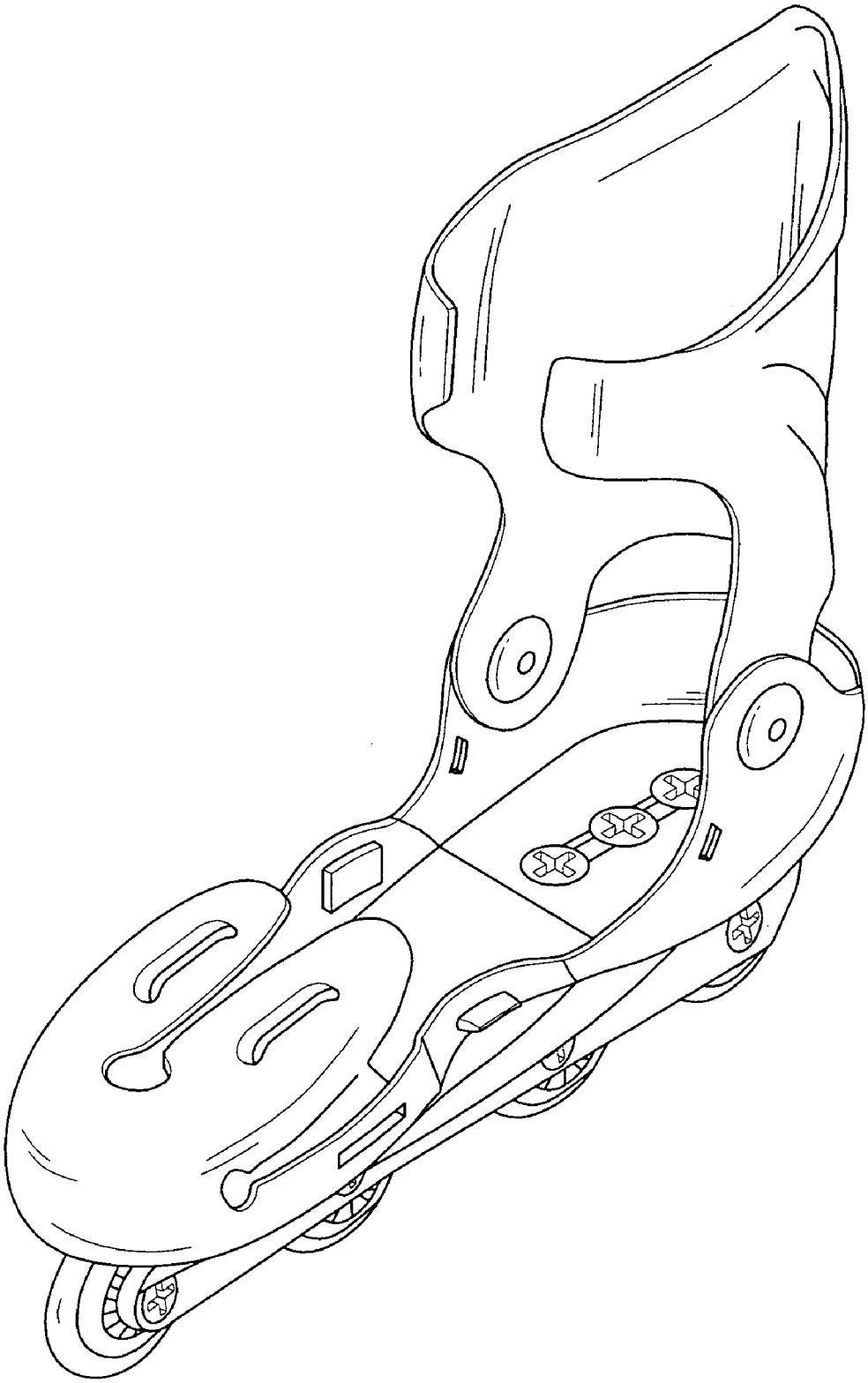
Fig.1 PRIOR ART
FIG. 1 is a perspective view of a conventional roller skate.
Figure 2:
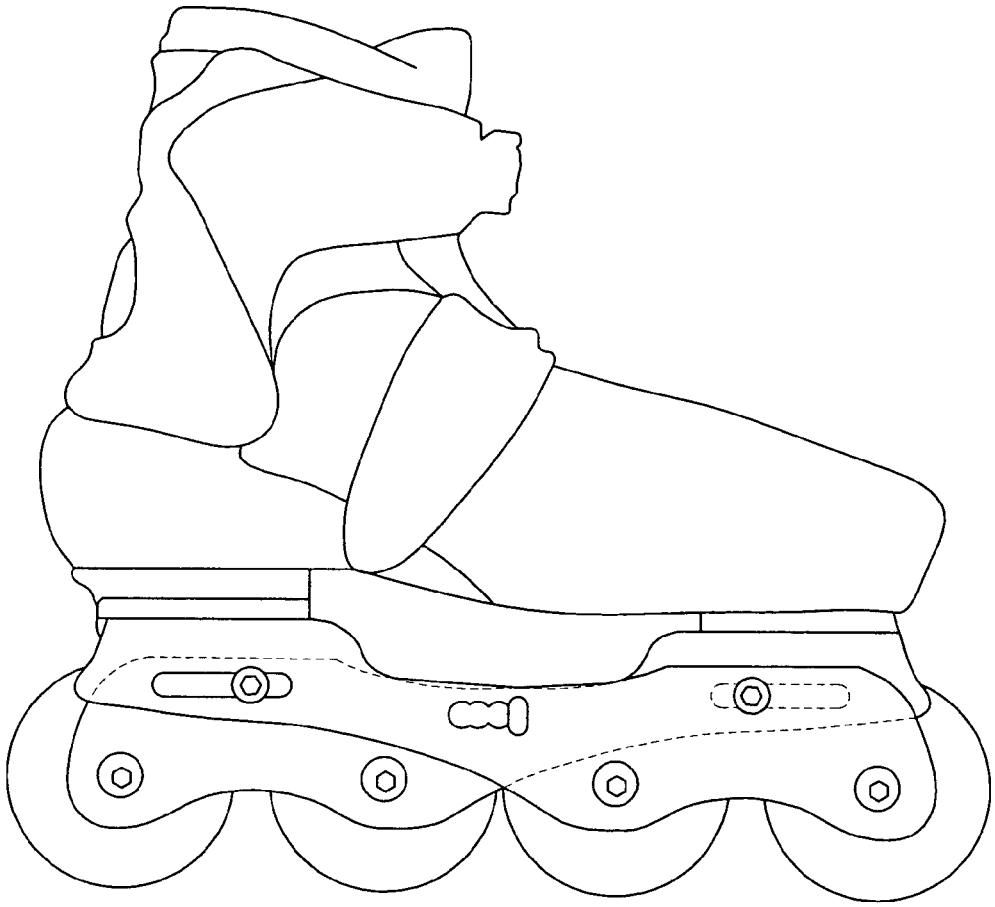
Fig.2 PRIOR ART
FIG. 2 is a side view of a conventional roller skate.
Figure 3:
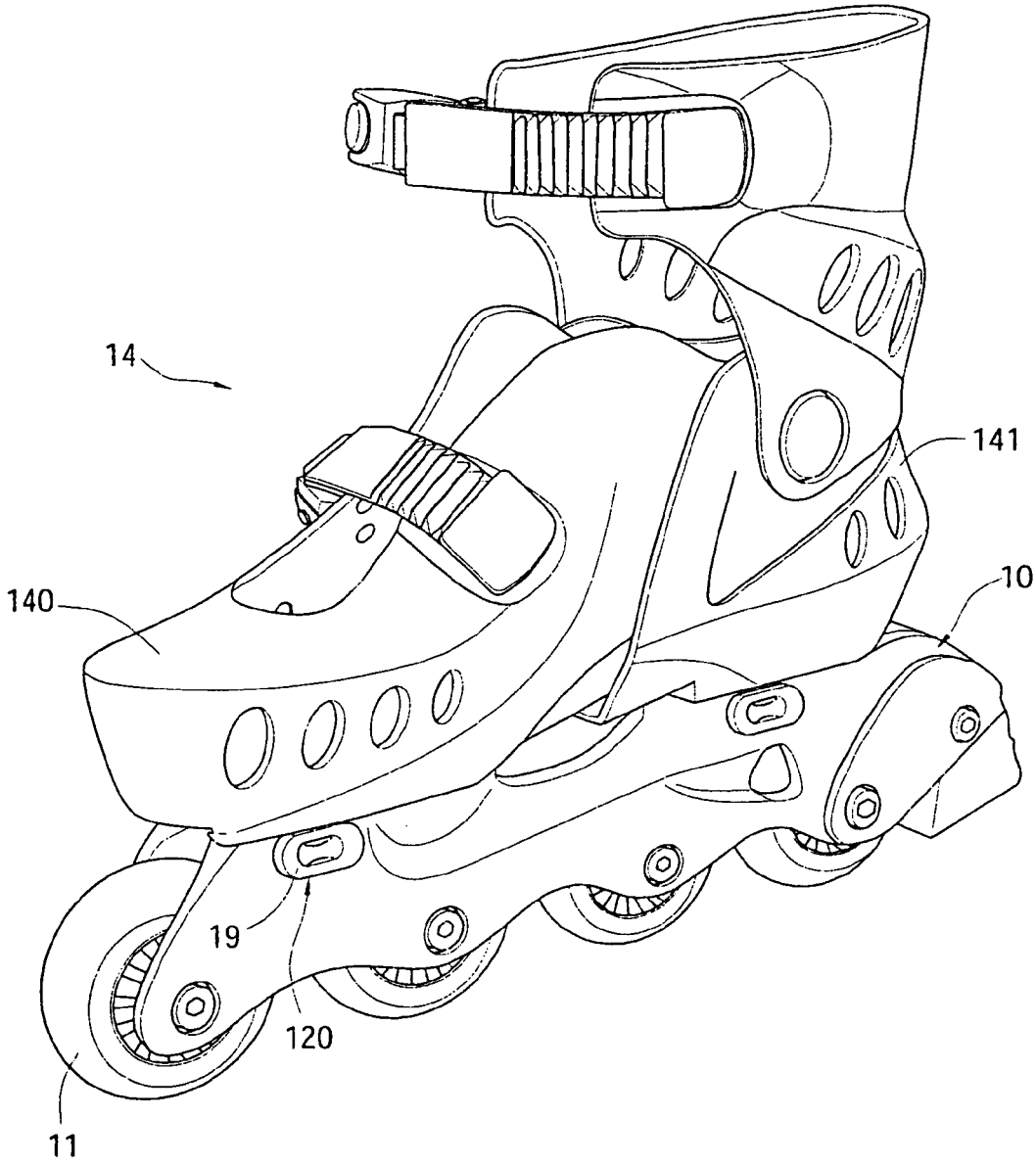
FIG. 3 is a perspective view of the embodiment of the present invention.

Referring to FIG. 3, the roller skate according to the invention basically includes a truck 10 which has a plurality of wheels 11 on the bottom to provide sliding function for the roller skate, a two-piece shoe cap 14 which includes a toe cap 140 and a heel cap 141 to accommodate the foot of a user with at least one of them being slidable on the top section of the truck 10, and (referring to FIG. 4) at least one adjusting bolt 120 located on one side of the truck 10. In normal conditions, the adjusting bolt 120 is fastened to one of the movable toe cap 140 and heel cap 141 for anchoring on the truck 10. The adjusting bolt 120 may also be moved to a release position to unfasten the movable toe cap 140 and heel cap 141 that has been anchored. Thus the relative position of the toe cap 140 and the heel cap 141 may be adjusted to suit different sizes of feet.

Figure 4:
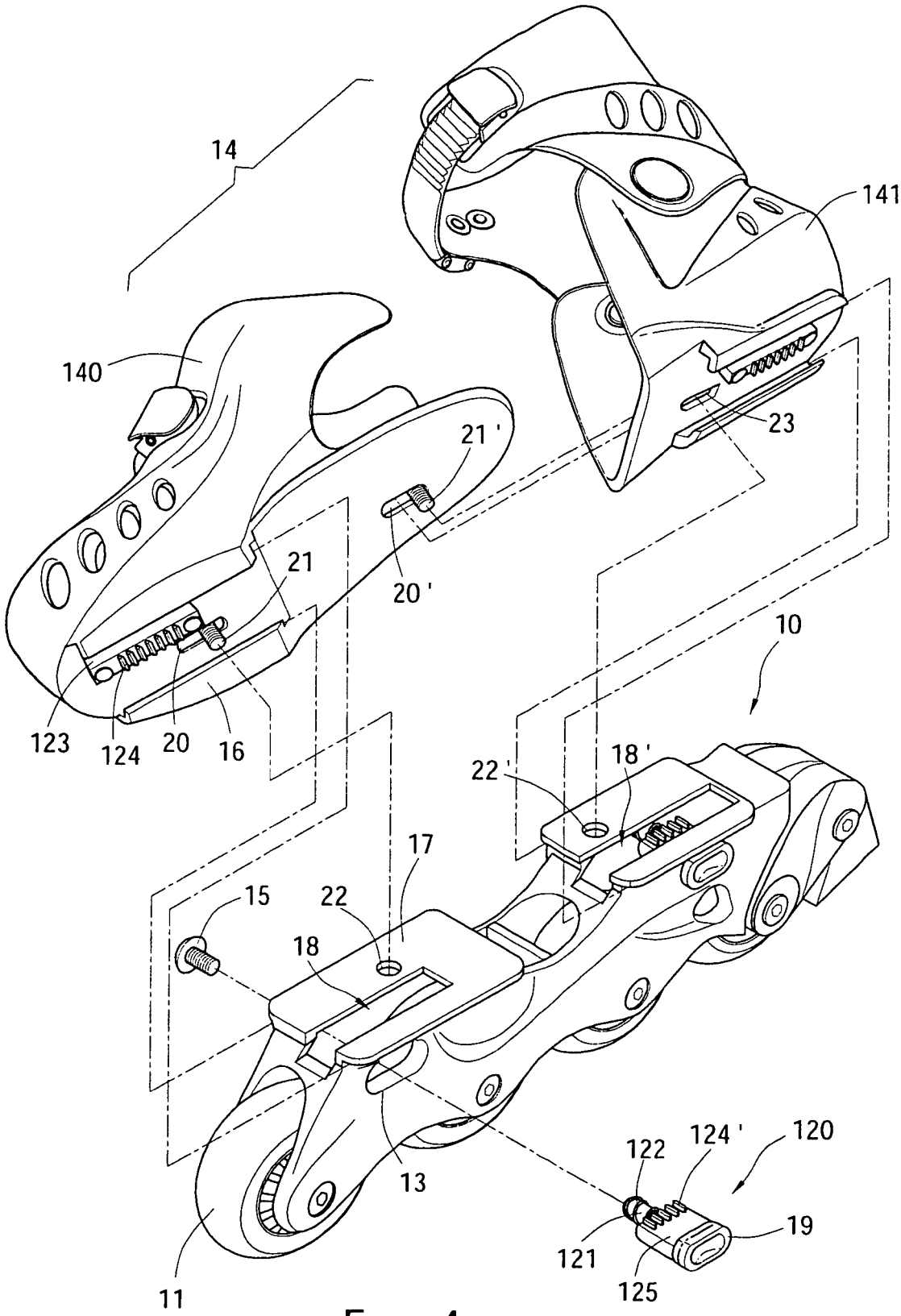
FIG. 4 is an exploded view of the embodiment of the present invention.

Referring to FIG. 4, the truck 10 aims at bracing the two-piece shoe cap 14 that have respectively a sliding track 17 and a sliding section 16 mating with each other to enable the two-piece shoe cap 14 to slide freely on the truck 10. The toe cap 140 and heel cap 141 have respectively an anchor section 123 on the bottom. The adjusting bolt 120 is housed in a housing trough 13 on the truck 10 to engage with a screw 15 located on a corresponding location. The adjusting bolt 120 and the anchor section 123 are used to adjust the position of the two-piece shoe cap 14 and alter its dimension. The toe cap 140 and heel cap 141 have a first sliding slot 20, a second sliding slot 20' and a third sliding slot 23 on a lower side to couple with a first fastening screw 21 and a second fastening screw 21'. The first fastening screw 21 passes through the first sliding slot 20 to engage with a first anchor hole 22 on the truck 10. The second sliding slot 20' is stacked over and aligned with the third sliding slot 23, and is coupled with the second fastening screw 21' to engage with the second anchor hole 22' located on the truck 10. The truck 10 has two tracks 18 and 18' on the upper side to enable the anchor section 123 to slide thereon.

The adjusting bolt 120 and the anchor section 123 have respectively a first coupling section 124 and a second coupling section 124' each being an elongated strip with jutting objects of equally paced pitches. The equal pitches enable the two to couple with each other and move transversely. The second coupling section 124' of the adjusting bolt 120 abuts a sliding trough 125 which is a flute with a smooth surface so that the first coupling section 124 of the anchor section 123 may be slid thereon for adjusting the dimension of the two-piece shoe cap 14.

Figure 5A:
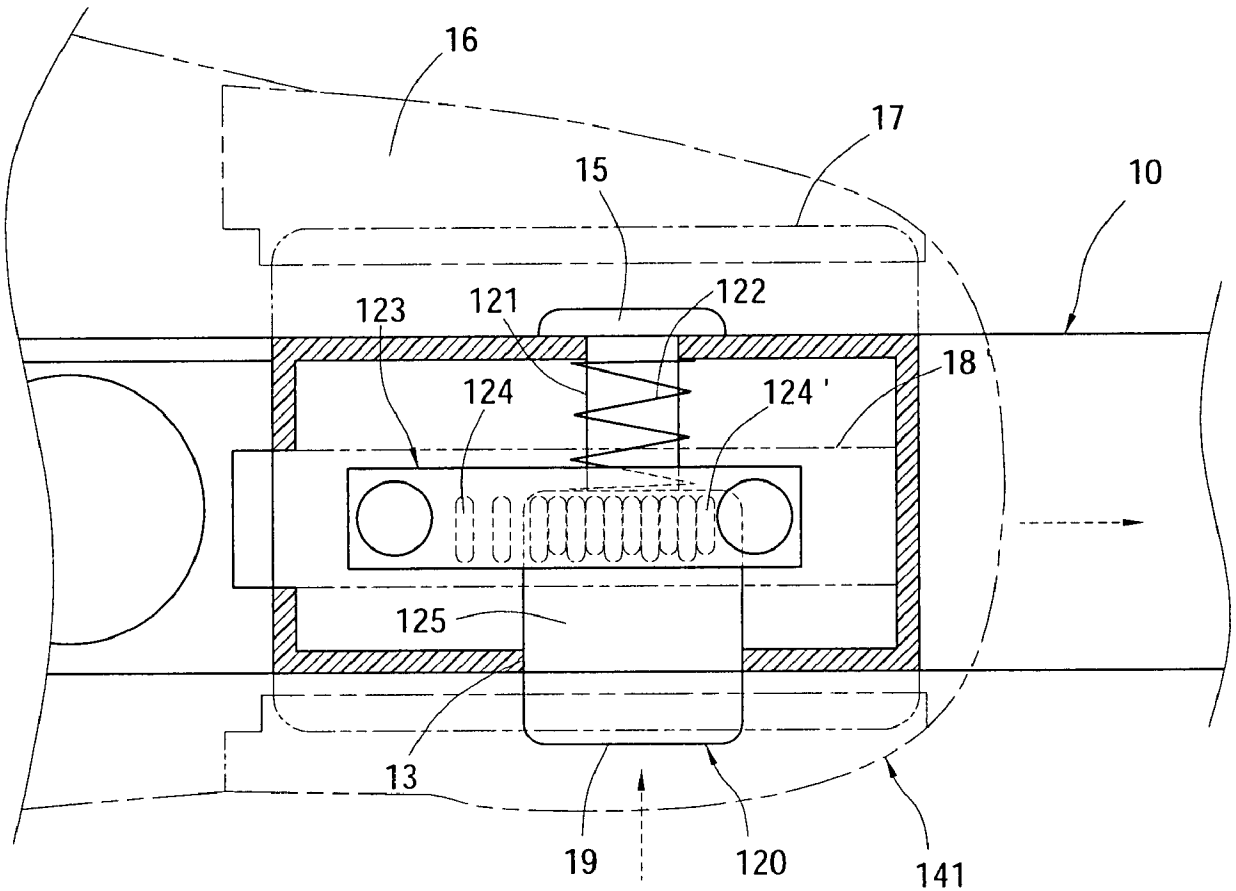
FIG. 5A is a schematic view of the embodiment of the present invention in an operating condition.
Figure 5B:
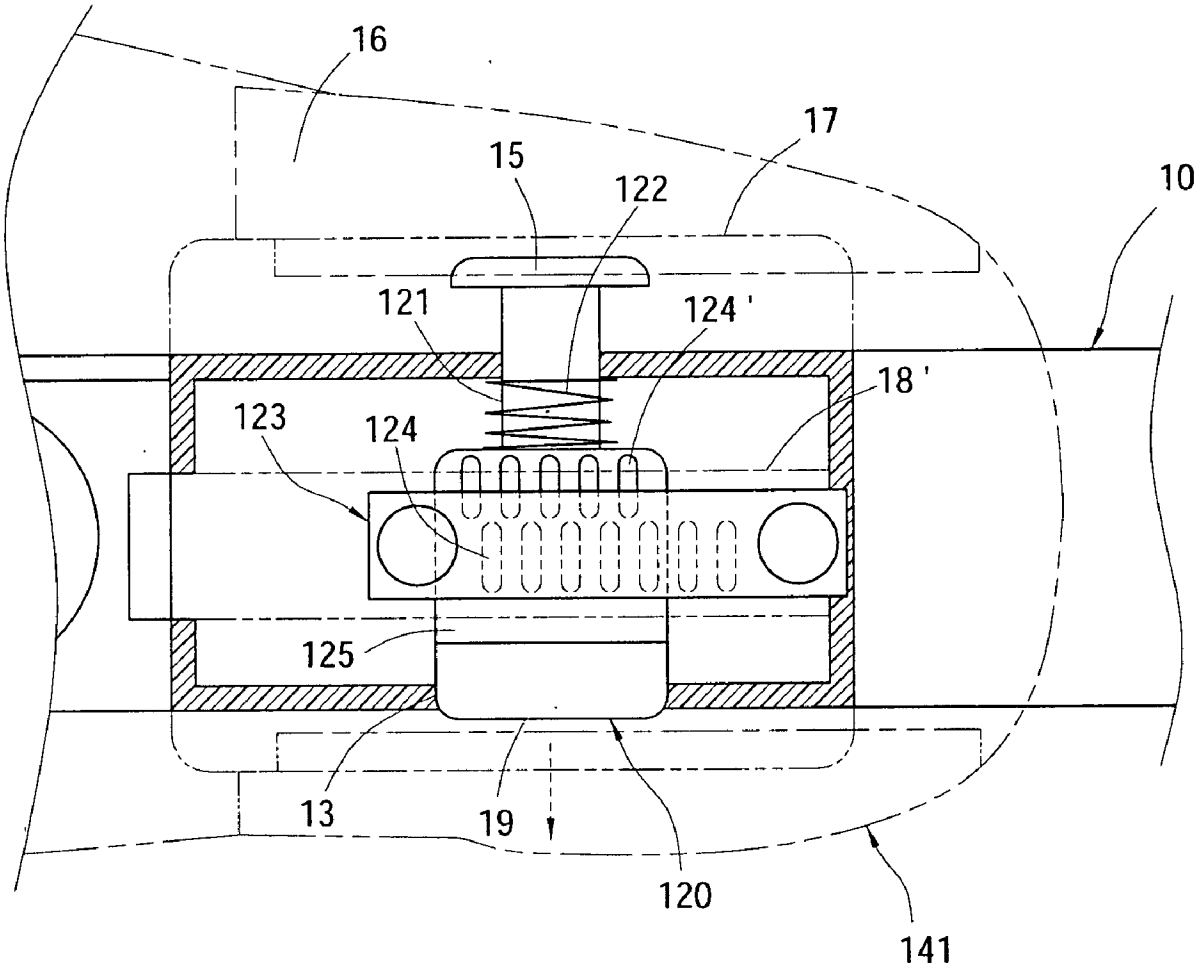
FIG. 5B is a schematic view of the embodiment of the present invention in another operating condition.
Figure 5C:
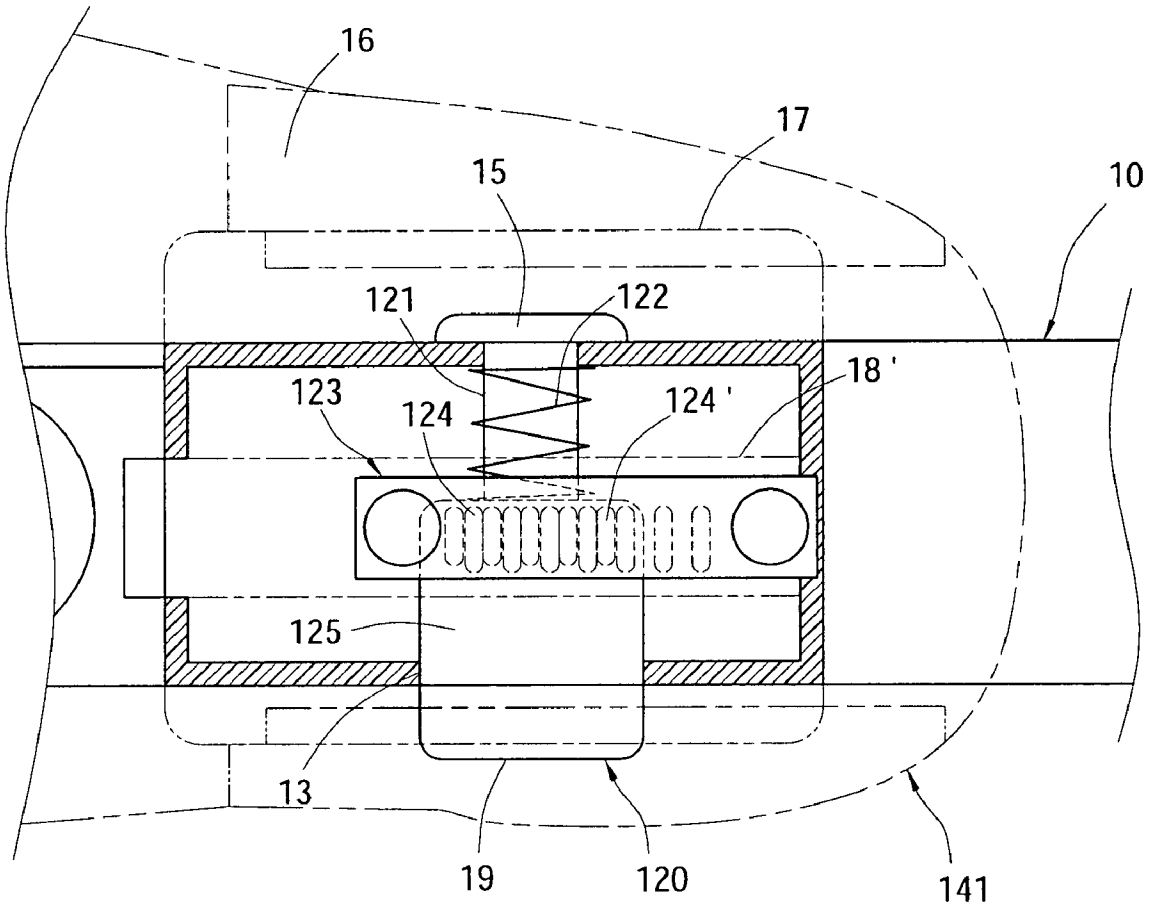
FIG. 5C is a schematic view of the embodiment of the present invention in yet another operating condition.

The adjusting bolt 120 is located in the housing trough 13 on one side of the truck 10. It has a depressing section 19 extending from one side the truck 10 and a round tube 121 extending from another end. The round tube 121 has internal screw threads to engage with the screw 15 and also couples with an elastic element 122 from outside. The adjusting bolt 120 is located in a first position when the elastic element 122 is at the natural condition as shown in FIG. 5A. At this position the first coupling section 124 and the second coupling section 124' of the anchor section 123 and the adjusting bolt 120 are engaged with each other for anchoring. When the depressing section 19 is pushed, the elastic element 122 is compressed, and the adjusting bolt 120 is moved to a second position as shown in FIG. 5B. Hence through the elastic force of the elastic element 122, the position of the adjusting bolt 120 may be adjusted and the first coupling section 124 of the anchor section 123 may be slid to the sliding trough 125 for adjusting the position of the two-piece shoe cap 14. When a desired dimension is secured, the depressing section 19 is released as shown in FIG. 5C, the adjusting bolt 120 returns to the first position, and the first coupling section 124 and the second coupling section 124' of the anchor section 123 and the adjusting bolt 120 return to the engaging position to anchor the two-piece shoe cap 14.

Moreover, the anchor section 123 may be separately formed on the toe cap 140 or the heel cap 141. However, the adjusting bolt 120 has to mate with the truck 10 at a desired location. The relative locations of the adjusting bolt 120 and the anchor section 123 may be switched.

What is claimed is:

1. A roller skate with an adjustable longitudinal dimension, comprising:

a truck having a sliding track on a top section and a plurality of wheels on a bottom section allowing forward and backward sliding for the roller skate;

a two-piece shoe cap which includes a toe cap and a heel cap that have respectively an anchor section and a sliding section located thereunder, the sliding section of each of said top cap and said heel cap mating with the sliding track; and at least one adjusting bolt located on one side of the truck being depressible to release the anchor section of at least one of the toe cap and the heel cap anchored on the truck so that at least one of the toe cap and the heel cap are movable on the top section of the truck to adjust the longitudinal dimension of the roller skate.

2. The roller skate with the adjustable longitudinal dimension of claim 1, wherein the adjusting bolt has a sliding trough and a second coupling section.

3. The roller skate with the adjustable longitudinal dimension of claim 1, wherein the anchor section has a first coupling section.

4. The roller skate with the adjustable longitudinal dimension of claim 3, wherein the first and the second coupling section is a jutting object which has equally spaced pitches.

5. The roller skate with the adjustable longitudinal dimension of claim 1, wherein the adjusting bolt is coupled with an elastic element.

6. The roller skate with the adjustable longitudinal dimension of claim 5, wherein the elastic element is a spring.

7. The roller skate with the adjustable longitudinal dimension of claim 1, wherein the toe cap has a first sliding slot on a front side and a first fastening screw, the truck having a first anchor hole engageable with the first sliding slot and the first fastening screw such that the toe cap is slidable through the first sliding slot.

8. The roller skate with the adjustable longitudinal dimension of claim 1, wherein the toe cap has a second sliding slot on a rear side and a second fastening screw, the heel cap having a 'third' sliding slot, the second fastening screw passing through the second sliding slot and the third sliding slot to engage with a second anchor hole formed on a rear section of the truck to couple the toe cap with the heel cap and allow the toe cap and the heel cap to be slidable on the truck.

* * * * *